United States Patent [19]

Harrison et al.

[11] 4,149,214

[45] Apr. 10, 1979

[54] IGNITION DEVICES

[75] Inventors: Ronald A. Harrison, Fareham; Brian E. Hutchings, Gosport, both of England

[73] Assignee: Plessey Handel und Investments A.G., Zug, Switzerland

[21] Appl. No.: 746,612

[22] Filed: Dec. 1, 1976

[30] Foreign Application Priority Data

Dec. 2, 1975 [GB] United Kingdom ..... 49523/75

[51] Int. Cl.[2] ..... F23Q 3/00

[52] U.S. Cl. ..... 361/256; 200/159 R

[58] Field of Search ..... 361/253, 256, 257; 200/159 R, 159 A

[56] References Cited

U.S. PATENT DOCUMENTS

| | | | |
|---|---|---|---|
| 3,244,847 | 4/1966 | Erpel | 200/159 R |
| 3,781,163 | 12/1973 | Ovens | 361/256 |
| 3,824,432 | 7/1974 | Gersing | 361/256 |
| 3,918,887 | 11/1975 | Lamprecht et al. | 361/256 |

*Primary Examiner*—J. V. Truhe

*Assistant Examiner*—Clifford C. Shaw

*Attorney, Agent, or Firm*—Fleit & Jacobson

[57] ABSTRACT

A hand-operated portable electric ignition device for the ignition of gas comprises within an insulating housing means for producing from a battery relatively high voltage alternating current pulses in response to the operation of a manually-operable switch, said means including a transistor oscillator circuit, rectifying means for rectifying the alternating current pulses for charging a capacitor and means arranged to conduct to provide for the discharge of the capacitor through the primary of a transformer in the output circuit of which is a spark gap across which sparking occurs when the charge voltage on the capacitor reaches a predetermined value. The manually-operable switch comprises an actuating button which is slidably mounted in the housing and which engages with a free end of springy relatively stiff wire constituting the moving contact of the switch and in response to the depression of the actuating button the wire contact makes wiping contact with a fixed contact plate having its contact edge disposed oblique to the direction of movement of the actuating button.

5 Claims, 5 Drawing Figures

IGNITION DEVICES

This invention relates to electric ignition devices and relates more specifically to portable hand-operated electric ignition devices.

According to the present invention there is provided a hand-operated portable electric ignition device for the ignition of gas which comprises within an insulating housing means for producing from a battery relatively high voltage alternating current pulses in response to the operation of a manually-operable switch, said means including a transistor oscillator circuit, rectifying means for rectifying said alternating current pulses for charging a capacitor, and means arranged to conduct to provide for the discharge of said capacitor through the primary of a transformer in the output circuit of which is a spark gap across which sparking occurs when the charge voltage on the capacitor reaches a predetermined value, said manually-operable switch comprising an actuating button which is slidably mounted in said housing and which engages with a free end of springy relatively stiff wire constituting the moving contact of said switch and in response to the depression of said actuating button the wire contact makes wiping contact with a fixed contact plate having its contact edge disposed obliquely to the direction of movement of said actuating button.

By way of example the present invention will now be described with reference to the accompanying drawings in which.

Figure 1:
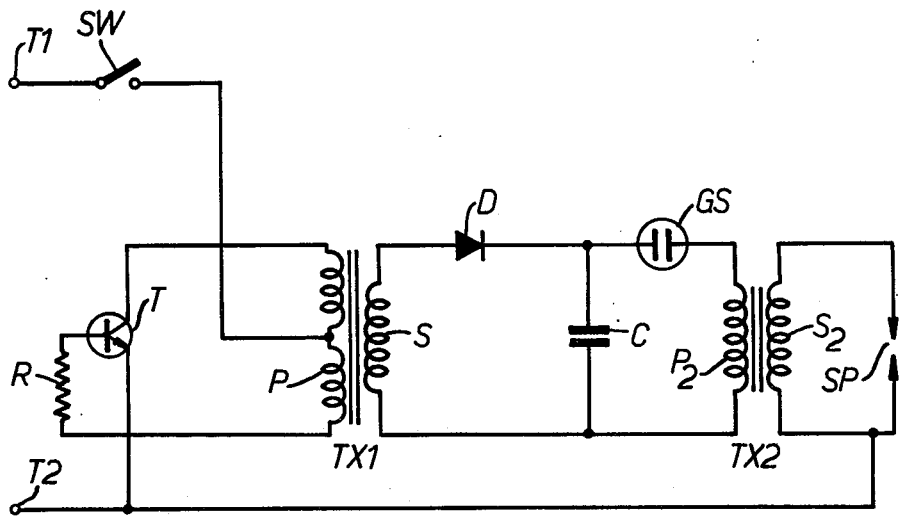
FIG. 1 is a circuit diagram of a portable hand-operated electric lighter.

Referring to the drawing, the portable hand-operated electric lighter illustrated is intended for the ignition of gas.

Referring to FIG. 1 the circuit of the lighter comprises a transistor oscillator including transistor T having its base connected to one terminal $T_1$ of a $1\frac{1}{2}$ volt battery through a resistor R and one part of a tapped primary winding P of a step-up transformer $TX_1$ and having its collector connected to the terminal $T_1$ through the other part of the winding P. The emitter of the transistor T is connected to the other terminal $T_2$ of the battery. The transformer $TX_4$ may comprise a small ferrite-cored wire coil.

In operation of the device the transistor oscillator in response to the operation of a manually-operable switch SW, the construction of which will be described with reference to FIGS. 2 to 5, will feed pulses to the primary winding P and these pulses will be stepped up for example to 600 volts peak by secondary winding S. The output pulses from $TX_1$ are rectified by diode D and used to charge capacitor C.

When the capacitor C is charged to a predetermined voltage a gas discharge device GS comprising a gas-filled spark gap breaks down to allow the capacitor C to discharge through primary winding $P_2$ of a pulse transformer $TX_2$. The resultant current flow causes a high voltage pulse output from secondary winding $S_2$, which causes spark electrode SP connected across it to spark over. The device GS has a low resistance so that virtually the full voltage stored in the capacitor is developed across the primary winding $P_2$. Also the voltage at which the gas filled spark gap device extinguishes is low compared with its break-down voltage so that the capacitor is discharged to a low voltage.

The transistor oscillator may operate at a frequency of 5 to 10 KHz and the time taken to charge the capacitor which may be of 1 microfarad, may be approximately $\frac{1}{2}$ second.

The circuit lends itself well to miniaturisation and the various circuit components are accommodated within the handle of a portable pistol-like lighter.

Figure 2:
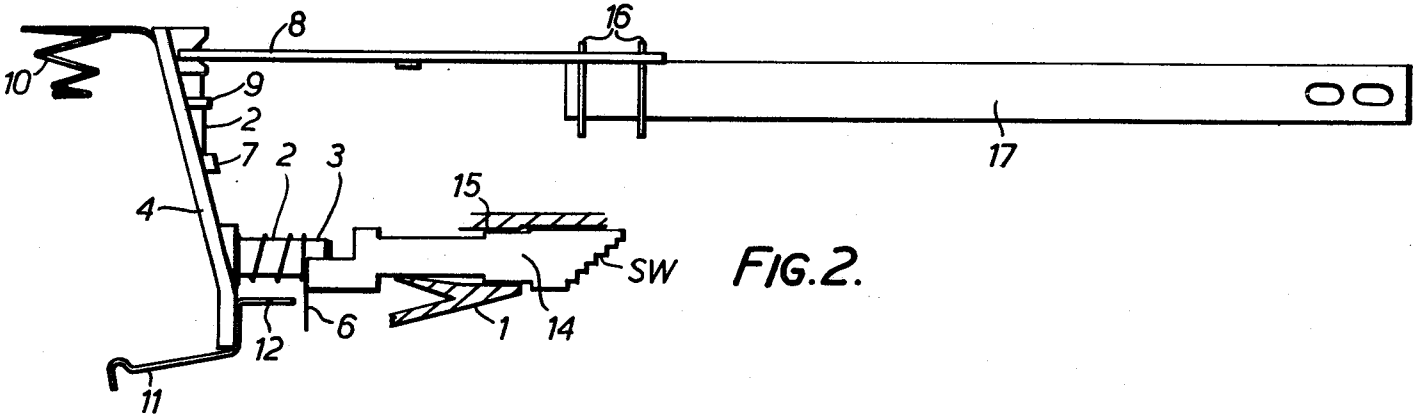
FIGS. 2 and 3 show side and underneath views of some component parts of the lighter.
Figure 3:
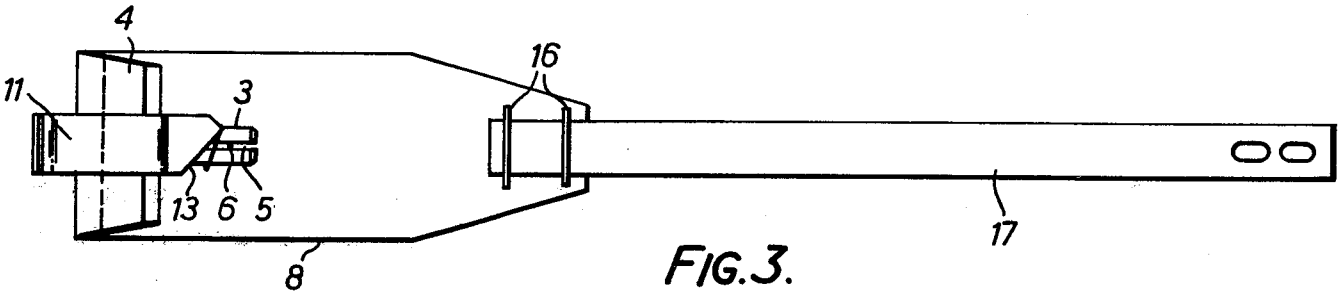
Figure 4:
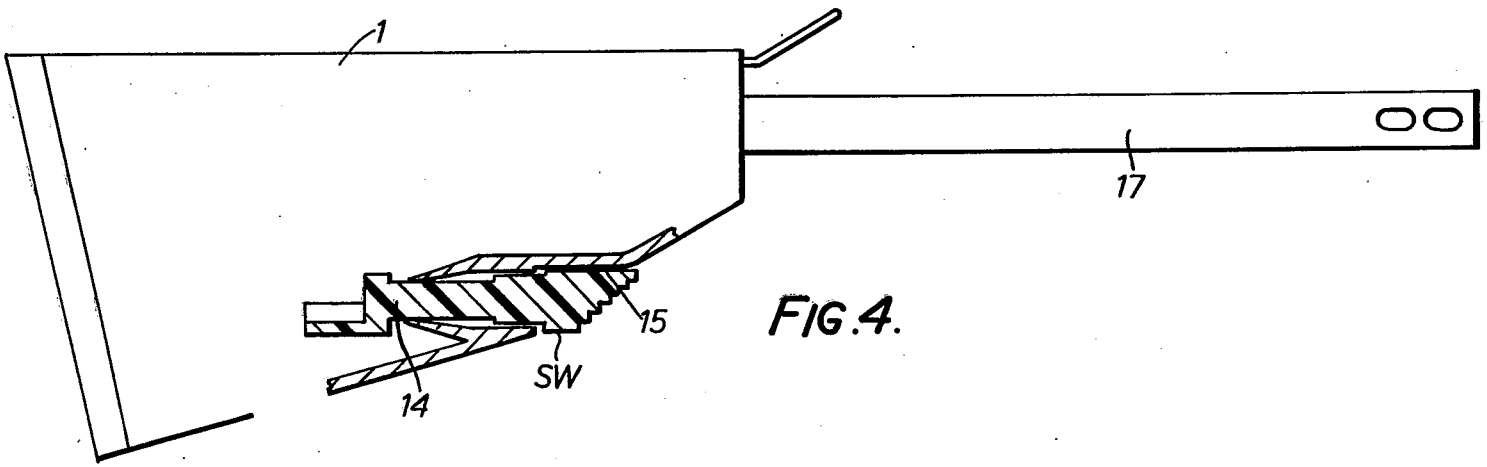
FIGS. 4 and 5 show side and underneath views of the completed lighter.
Figure 5:
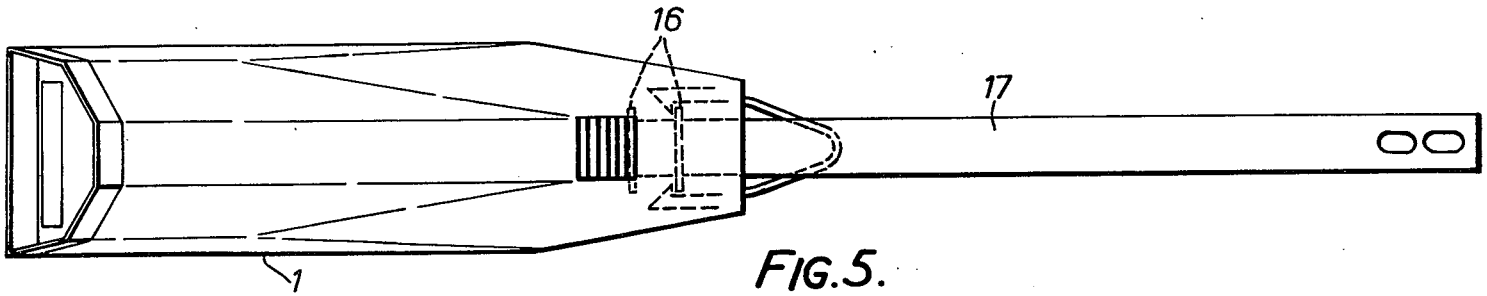

Referring now to FIGS. 2 to 5 of the accompanying drawings, these show the pistol-like construction of the lighter the circuit of which has been described with reference to FIG. 1. The lighter comprises an insulated housing 1 which may conveniently be moulded of plastics material which accommodates the various components required for the circuit arrangement shown in FIG. 1. In the interests of clarity most of these components have been omitted from the FIGS. 2 to 5 in order to show the manually-operable switch SW of the lighter more clearly. As can best be seen from FIG. 2 of the drawings a moving contact of the manually-operable switch SW comprises a relatively stiff springy wire 2 which is coiled around a spigot 3 formed on an insulating support plate 4. This spigot 3 is provided with a slot 5 as can be seen in FIG. 2 through which the free end 6 of wire contact extends to define the moving contact portion. The springy wire 2 is held back against the support plate 4 by means of a moulded cleat 7 and it extends to a printed circuit board 8 via a V-notched projection 9 on the support plate 4. The printed circuit board to which the wire 2 is attached by soldering the wire to printed copper wiring carries various electric components of the lighter (e.g. transformers, transistor diode etc.) mounted on the underside of the printed circuit board 8 as viewed in in FIG. 2. A spiral spring 10 which is connected to the printed circuit board by means of a cleat serves as a battery terminal contact member. The other battery terminal contact member 11 has an extension 12 which constitutes the fixed contact of the manually-operable switch SW. The fixed contact 12 has an edge 13 which is oblique to the direction of movement of a switch actuator button 14 of the lighter. The actuator button 14 is slidably mounted in an opening 15 in the housing 1. In response to movement of the actuator button 14 the springy wire moving contact 6 is urged into engagement with the oblique edge 13 of the fixed contact 12 so that it makes sliding or wiping contact therewith for completing the ignition circuit of FIG. 1. The actuator button 14 is arranged so that at its foremost end it has a recess which receives the end of the spigot 3 on the support plate 4. A spark electrode (not shown) of the arrangement of FIG. 1 is positioned at the free end of the metal nozzle 17 which is attached to the printed circuit board by plastic clips 16. The nozzle 17 provides the return path for the spark circuit shown in FIG. 1.

As will be appreciated from the foregoing description the lighter according to the invention has a very simple and cheap construction of operating switch the reliability of which is much enhanced by the wiping action of the moving contact over the fixed contact.

What we claim is:

1. A pistol-like hand-operated portable electric ignition device for the ignition of gas which comprises an insulating housing, supporting means for supporting a battery within said housing, manually-operable switch means interconnecting said supporting means with a circuit means for providing relatively high voltage alternating current pulses in response to the operation of said manually-operable switch means, said circuit means including a transistor oscillator circuit for providing alternating current pulses, rectifying means for rectifying said alternating current pulses for charging a capacitor, conducting means arranged to conduct to provide for the discharge of said capacitor through the primary of a transformer when said capacitor is charged to a predetermined value, a spark gap across the secondary of said transformer wherein sparking occurs when the charge voltage on the capacitor reaches a predetermined value, said manually-operable switch means comprising a trigger-like actuating button of insulating material which is slidably mounted in said housing and which engages with a free end of a coiled springy relatively stiff wire constituting a moving contact of said switch means in response to the depression of said actuating button, a fixed contact plate having a contact edge disposed obliquely to the direction of movement of said actuating button, and means for positioning said fixed contact plate adjacent said moving contact so that said wire contact slides along said contact edge when said actuating button is manually triggered.

2. A hand-operated portable electric ignition device as claimed in claim 1, further comprising an elongated metal nozzle interconnected with said housing, wherein said spark gap is located at the open end of said metal nozzle.

3. A hand-operated portable electric ignition device as claimed in claim 2, further comprising an insulating supporting plate, a cylindrically-shaped spigot means extending from said supporting plate for supporting said moving contact of said switch means, said spigot means defining a slot extending therethrough, said coiled springy relatively stiff wire defining said moving contact being wound about said cylindrically-shaped spigot means wherein a free end of said coiled wire extends through said slot, said actuating button including an end portion positioned adjacent said free end of said coiled wire, wherein said actuating button engages said free end of said coiled wire during movement so that said free end slides along the oblique contact edge of said fixed contact plate.

4. A hand-operated portable electric ignition device as claimed in claim 3, wherein said supporting means for supporting a battery comprises a terminal contact member, said terminal contact member affixed to said supporting plate, and wherein said fixed contact plate of said switch means is integral with said terminal contact member.

5. A hand-operated portable electric ignition device as claimed in claim 1 wherein said coiled wire further comprises the sole means for returning said actuating button to its initial position following manual triggering.

* * * * *